US008561303B2

(12) United States Patent
Landrie et al.

(10) Patent No.: US 8,561,303 B2
(45) Date of Patent: Oct. 22, 2013

(54) SYSTEM AND METHOD FOR HAIR CLIPPING AND REMOVAL

(75) Inventors: Daniel Joseph Landrie, Green Bay, WI (US); Larry H. Panzer, Sheboygan Falls, WI (US)

(73) Assignee: Surgical Site Solutions, Inc., Sheboygan, WI (US)

( * ) Notice: Subject to any disclaimer, the term of this patent is extended or adjusted under 35 U.S.C. 154(b) by 378 days.

(21) Appl. No.: 13/040,548

(22) Filed: Mar. 4, 2011

(65) Prior Publication Data

US 2011/0185578 A1 Aug. 4, 2011

Related U.S. Application Data

(63) Continuation-in-part of application No. 12/395,703, filed on Mar. 1, 2009, now Pat. No. 8,225,512.

(51) Int. Cl.
*B25F 3/00* (2006.01)

(52) U.S. Cl.
USPC ..... 30/133; 30/41.6

(58) Field of Classification Search
USPC ..... 30/41.6, 123, 131, 132, 133
See application file for complete search history.

(56) References Cited

U.S. PATENT DOCUMENTS

| | | | |
|---|---|---|---|
| 1,618,713 | A | 2/1927 | Kaufmann |
| 2,129,559 | A | 9/1938 | Blackwell |
| 2,228,020 | A | 1/1941 | Nicholas |
| 2,697,876 | A | 12/1954 | Blanchard |
| 2,748,472 | A | 6/1956 | Sheley et al. |
| 2,946,122 | A | 7/1960 | Gaskins |
| 3,217,407 | A | 11/1965 | Azar |
| 3,230,619 | A | 1/1966 | Felland |
| 3,295,200 | A | 1/1967 | Padgett et al. |
| 3,302,286 | A | 2/1967 | Zucker |
| 3,331,130 | A | 7/1967 | Ligon |
| 3,348,308 | A | 10/1967 | Andis |
| 3,383,765 | A | 5/1968 | Meltzer |
| 3,384,919 | A | 5/1968 | Jording et al. |
| 3,440,661 | A | 4/1969 | Hixon et al. |
| 3,611,566 | A | 10/1971 | Brennan, Sr. |
| 3,669,652 | A | 6/1972 | Deverman et al. |
| 3,797,111 | A | 3/1974 | Keane |
| 4,077,122 | A | 3/1978 | Rollor, Jr. et al. |
| 4,216,481 | A | 8/1980 | Hakoyama |
| 4,667,405 | A | 5/1987 | Trichell et al. |
| 4,843,717 | A | 7/1989 | Crane |
| 4,974,321 | A | 12/1990 | Yoshida |
| 5,088,199 | A | 2/1992 | Romani |
| 5,142,786 | A | 9/1992 | Hunts |
| 5,153,994 | A | 10/1992 | Emmett |
| D337,176 | S | 7/1993 | Romani |
| D348,543 | S | 7/1994 | Melton |

(Continued)

FOREIGN PATENT DOCUMENTS

| | | |
|---|---|---|
| JP | 2-45009 | 2/1990 |

*Primary Examiner* — Hwei C Payer
(74) *Attorney, Agent, or Firm* — Ryan Kromholz & Manion, S.C.

(57) ABSTRACT

A system for clipping and removing hair clippings from a clipped site is disclosed. The system includes a suction member having an integrated blade member, a hose member in communication with the suction member, and a vacuum source connected to the hose member. This device is particularly useful for use in clipping and removing the hair clippings from shaved surgical patients in a manner that prevents the hair clippings from falling into the patient's surroundings.

7 Claims, 5 Drawing Sheets

(56) References Cited

U.S. PATENT DOCUMENTS

| | | | | |
|---|---|---|---|---|
| 5,461,783 | A * | 10/1995 | Henderson | 30/124 |
| 5,881,462 | A | 3/1999 | Romani | |
| 5,924,202 | A | 7/1999 | Romani | |
| 5,960,515 | A | 10/1999 | Lu | |
| 6,571,478 | B1 | 6/2003 | Romani et al. | |
| 6,739,053 | B2 | 5/2004 | McCambridge et al. | |
| 7,114,257 | B1 | 10/2006 | Ortega | |
| 7,159,274 | B2 | 1/2007 | Freidell | |
| 7,228,630 | B2 | 6/2007 | Obermann | |
| 7,488,004 | B1 | 2/2009 | Romani et al. | |
| 8,225,512 | B2 * | 7/2012 | Coleman et al. | 30/133 |
| 2002/0108255 | A1 | 8/2002 | Degregorio, Jr. | |
| 2003/0101591 | A1 | 6/2003 | Romani et al. | |
| 2006/0230619 | A1 | 10/2006 | Williams et al. | |
| 2008/0250649 | A1 | 10/2008 | Spigai | |

* cited by examiner

SYSTEM AND METHOD FOR HAIR CLIPPING AND REMOVAL

RELATED APPLICATIONS

This is a continuation-in-part of U.S. patent application Ser. No. 12/395,703, filed 1 Mar. 2009, now U.S. Pat. No. 8,225,512.

FIELD OF THE INVENTION

The present invention relates to a hair clipper vacuum device and method for clipping and removing shaved or clipped hair. More specifically, the present invention is a disposable hair clipper vacuum device and integrally formed surgical hair clipper blade.

BACKGROUND OF THE INVENTION

Surgical patients are often shaved prior to invasive or surgical procedures around the areas of incision to remove hair that might harbor germs and thus serve as a source of contamination. The patients are commonly shaved in their hospital rooms, preoperative area or in the surgical suite. Loose hair clippings that remain on the patient, fall onto the sheets, covers and bed surroundings must be picked up and removed. At present, the most common protocol for picking up the loose hair clippings is to press an adhesive backed material, usually a tape, against the area where the clipped hair remains. This method, however, is unsanitary, inefficient and misses many hair clippings, which is potentially harmful to the patient. Furthermore, adhesive tapes are not typically kept under sterile conditions which increase the risk of spreading infectious contaminants not only through the surgical suite but possibly throughout the medical facility. In addition, patients may be allergic or otherwise reactive to the adhesive used in tape. Thus, there is a need for a more efficient, sanitary and cost effective method for clipping and hair removal.

Several prior art patents disclose vacuum devices attached to hair grooming clippers and shavers typically used in barber shops. Among these are U.S. Pat. Nos. 6,571,478, 5,924,202, 5,881,462, and 3,348,308. However, the prior art vacuum attachments have several shortcomings, namely, they do not fit most surgical clipper designs, are not integrally formed with clipper blades, and are furthermore not designed to be disposable.

SUMMARY OF THE INVENTION

In one aspect of the present invention, a device comprises a suction member having a hose attachment port, a suction port, and an integrated blade member. A hose attachment may be connected to the suction member at the hose attachment port. The blade member is preferably attached to a bottom side of the suction member.

The present invention is directed to a system and method for clipping and removing hair from a surgical area. A system according to the present invention includes a suction member and an integrally formed clipper blade member. The blade member may be integrally formed with a bottom surface of the suction member. The blade member is preferably further adapted to couplingly engage a selected clipper body during use. The suction member preferably includes a hose attachment port and a suction port. The system may further include a hose having a first end and a second end, with the first end of the hose being adapted for connection to the hose attachment port of the suction member; and a vacuum source, with the vacuum source being connected to the second end of the hose. The system may further include a fastening member attached to, or integrally formed with, the bottom of the suction member and used for affixing the device onto a selected clipper body.

The device and system of the present invention is particularly useful for clipping hair and removing the hair clippings of patients that are to undergo surgical procedures. The invention further provides an efficient and sanitary method. The device and method may also be used and practiced in barber shops, animal grooming shops, and other applications in which hair is trimmed and a clean trimmed area is desired. The embodiments of the device and system are designed as integrated blade and vacuum systems for use with a selected, standard clipper body.

These and other features, aspects and advantages of the present invention will become better understood with reference to the following drawings, description and claims.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1A:
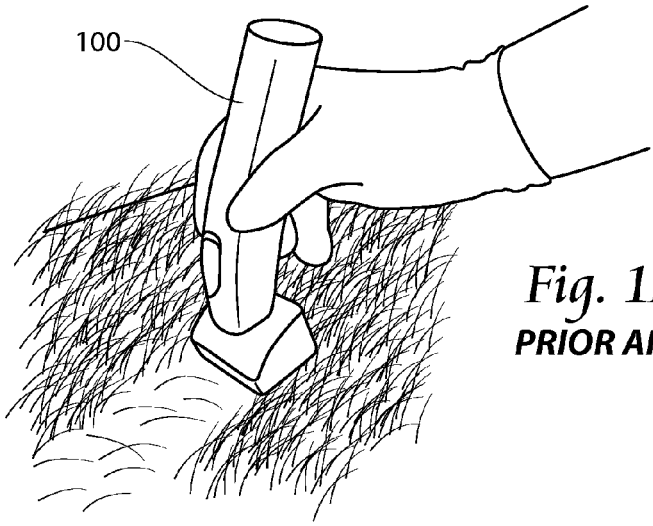
Fig. 1A PRIOR ART
FIGS. 1A and 1B are perspective views of a prior art method of pre-surgical clipping and hair removal.
Figure 1B:
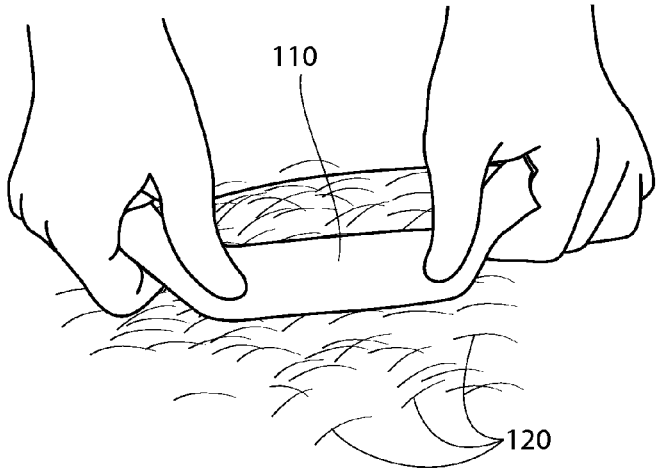
Fig. 1B PRIOR ART

As may seem in FIGS. 1A and 1B, prior art devices and methods for clipping and removing hair from a surgical site include the use of a standard clipper 100 followed by the application of adhesive tape 110 to remove clipped hair 120. As mentioned, this method is unsanitary, inefficient and misses many hair clippings 120. Further, patients may experience allergic reaction to adhesives used in such tape 110. In use in a surgical environment, this can be detrimental to the patient. Further, adhesive tape 110 is not typically kept under sterile conditions, which increases the risk of spreading infectious contaminants not only through the surgical suite but possibly throughout the medical facility.

Figure 2:
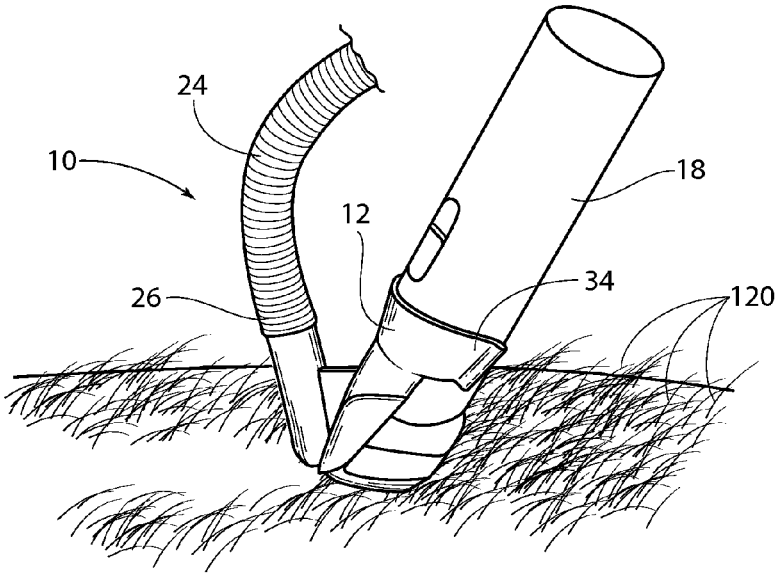
FIG. 2 is a perspective view of an embodiment of the present invention and showing use during clipping and hair removal.
Figure 10A:
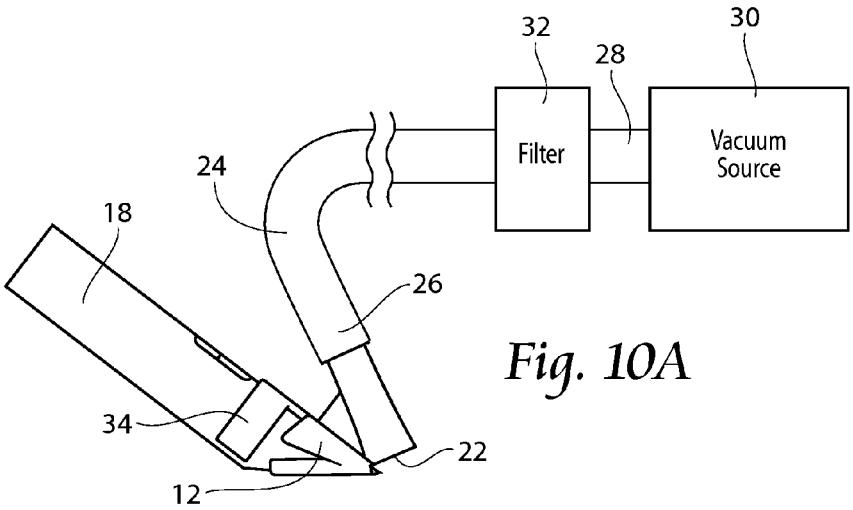
FIG. 10A is a schematic view illustrating the present invention engaged with a clipper body and vacuum source, with a filter located in-line on a hose member.

With reference now to FIG. 2, a system 10 and method for removing hair clippings from surgical patients according to the present may be seen. As illustrated, the present invention relates to a system and method for clipping and removing hair 120 from a surgical arena in an integrated unit. The system 10 preferably includes a suction member 12 having an integrally formed clipper blade member 14. The system may further include a hose member 24 for connection of the suction member 12 to a suction source (see FIG. 10).

Figure 3:
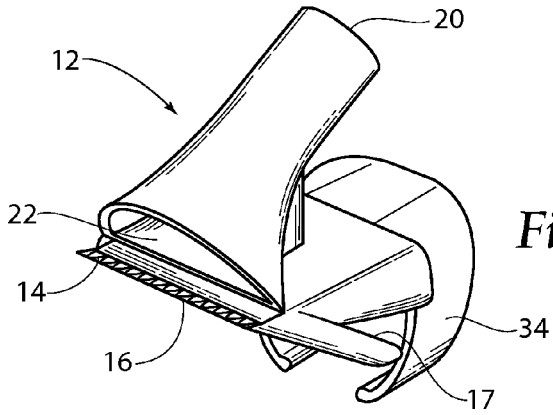
FIG. 3 is a perspective view of an embodiment of the present invention.
Figure 4:
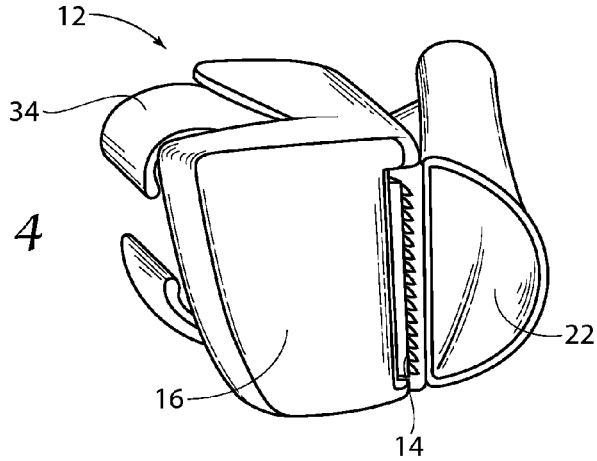
FIG. 4 is a bottom view of the device illustrated in FIG. 3.
Figure 5:
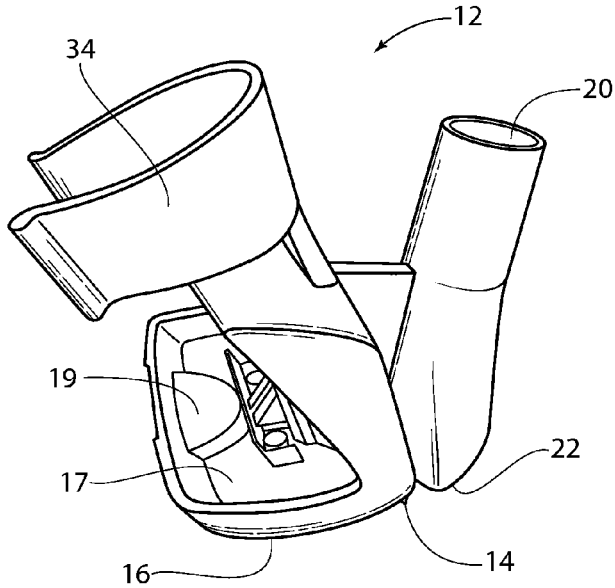
FIG. 5 is a top perspective view of the device illustrated in FIGS. 2-4 and showing a clipper body engagement structure.
Figure 6:
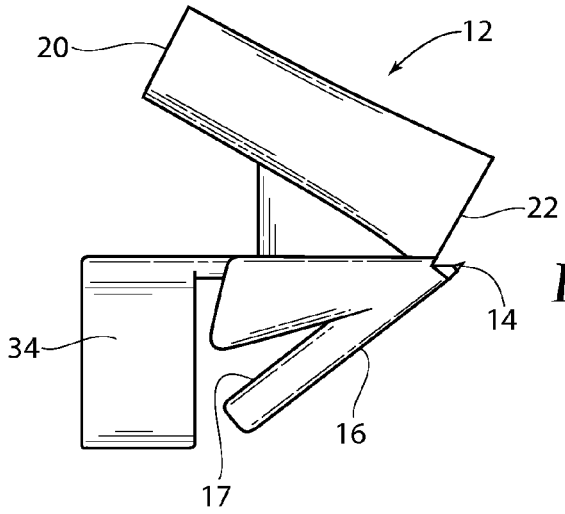
FIG. 6 is a side view of the device illustrated in FIGS. 3-5.
Figure 7:
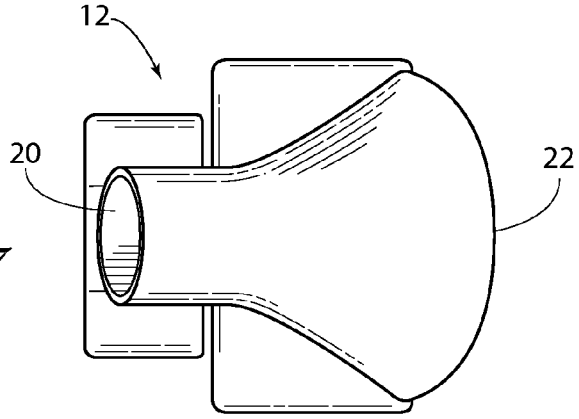
FIG. 7 is a top view of the device illustrated in FIGS. 3-6.
Figure 8:
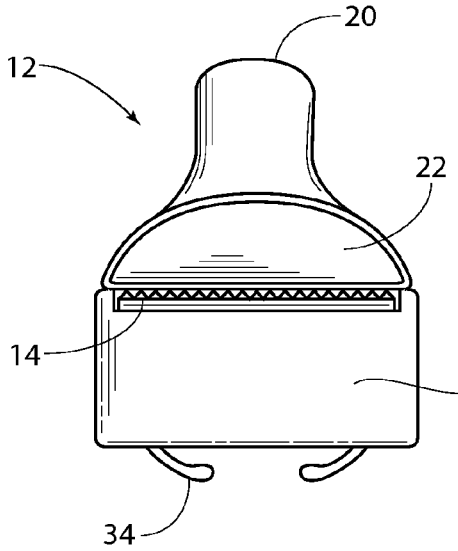
FIG. 8 is a front view of the device illustrated in FIGS. 3-7.
Figure 9A:
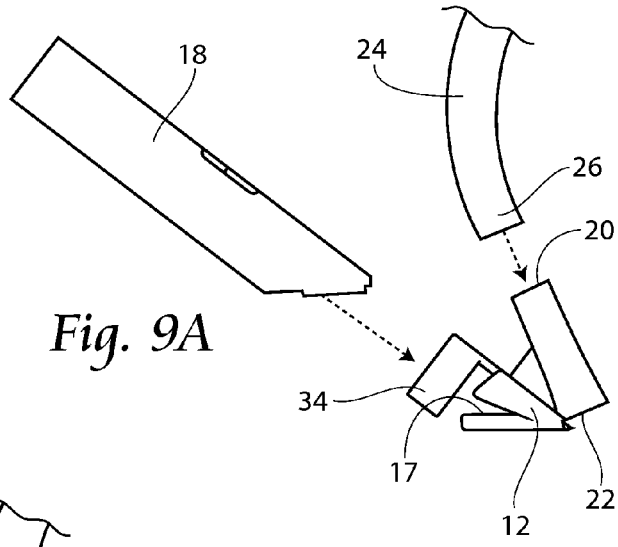
FIG. 9A is a view illustrating use of the present invention.
Figure 9B:
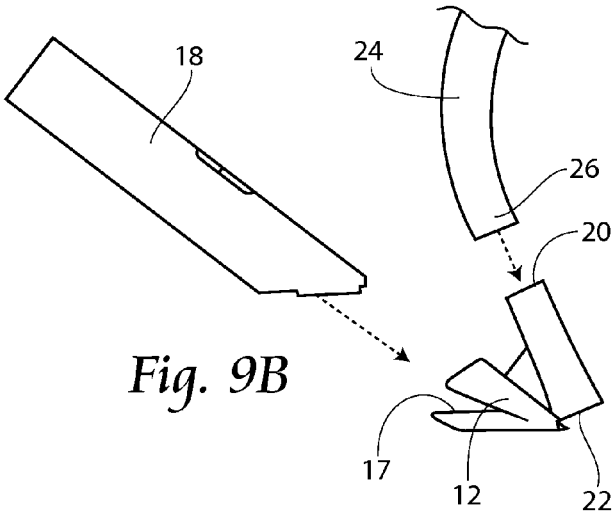
FIG. 9B is a view similar to that of FIG. 8B, but showing an alternative embodiment.
Figure 11:
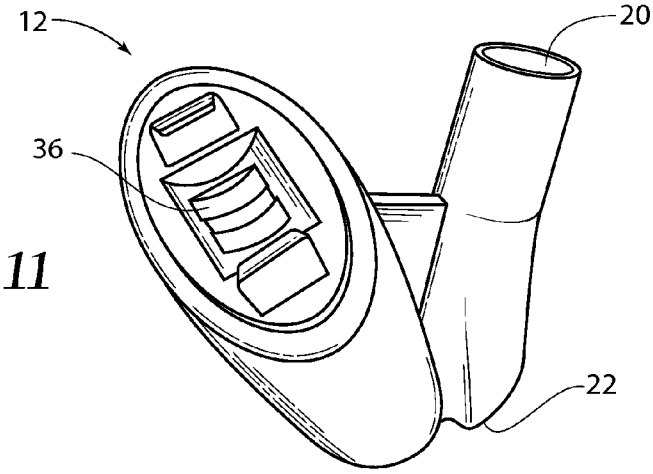
FIG. 11 is a view similar to that of FIG. 5, but showing an alternative clipper body engagement structure.
Figure 12:
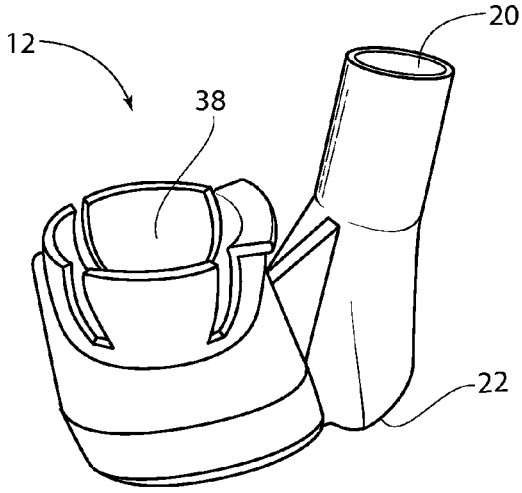
FIG. 12 is a view similar to that of FIGS. 5 and 11, but showing an alternative clipper body engagement structure.

With particular reference to the views of FIGS. 3 and 4, the blade member 14 may be seen as integrally formed with a bottom surface 16 of the suction member 12. The suction member 12 integrally formed blade member 14 is preferably further adapted to couplingly engage a clipper body 18 during use. A top surface 17 of the suction member 12 may include a clipper body engagement structure, such as the slide fit structure 19 shown in FIG. 5. Further examples of clipper body engagement structures for use to engage the suction member 12 and blade member 14 with a clipper body 18 may include screws, snap fit, friction fit, slide fit, press fit, or any other arrangement suitable to effectively engage the clipper body 18 selected for use. Examples of such clipper body engagement structures may be seen in the views of FIGS. 11 and 12, in which a press fit structure 36 and a ball-cup structure 38 are seen, respectively.

Any one of a number of clipper bodies 18 may be utilized with the present system, including, but not limited to, those sold or manufactured by Medline®, CardinalHealth®, CareFusion™ or 3M™. Accordingly, each specific clipper body 18 may have a different requirement for blade member 14 attachment. It is to be understood that the suction member 12 and blade member 14 of the present system 10 may include any of the engagement structures acceptable for use with a selected clipper body 18.

With reference now to FIGS. 3-8 it may be seen that the suction member 12 of the present system 10 further preferably includes a hose attachment port 20 and a suction port 22. As previously mentioned, the system 10 may further include a hose member 24 (see FIGS. 9A-10B) having a first end 26 and a second end 28. The first end 26 of the hose 24 is further preferably adapted for connection to the hose attachment port 20 of the suction member 12. The hose 24 may be flexible and extendable. The system 10 of the present invention is further adapted for connection to a vacuum source, such as a vacuum pump 30 using the previously mentioned hose 24. The second end 28 of the hose 24 is adapted for connection to the vacuum source 30 (see FIGS. 10A, 10B). As may be seen particularly in FIGS. 3, 4, and 8, the suction port 22 is positioned in close proximity to the blade member 14 such that hair 120 removed by the blade member 14 is quickly drawn away by the suction action of the vacuum source 30.

Figure 10B:
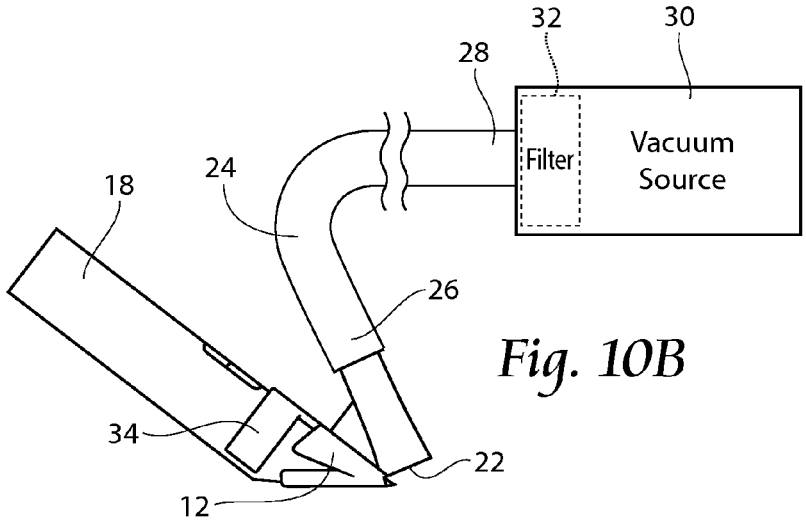
FIG. 10B is a schematic view similar to that of FIG. 9A, but showing a filter located in the vacuum source.

The present system 10 may be further provided with a hair clipping filter 32. With particular attention now to FIG. 10A, an in-line filter 32 may be provided in line on the hose member 24 to collect the hair clippings 120. Alternatively, and as shown in FIG. 10B, a filter 32 may be placed inside the vacuum pump 30 for similar purpose.

As illustrated in FIGS. 3-9A, the system 10 may further include a fastening member 34 attached to, or integrally formed with, the suction member 12 and used to assist in affixing the device onto a selected clipper body 18. It is to be understood that the design of the fastening member 34 may vary somewhat depending on the size and shape of the selected clipper body 18. Alternatively, and as shown in FIG. 9B, the system 10 may engage a clipper body 18 without the need for an additional fastening member 34.

It is to be understood that while the suction member 12, integrated blade member 14, and hose member 24 are preferably disposable, the vacuum pump 30 may be reused.

A method of using the system 10 includes the steps of: selecting a surgical site for hair clipping; providing a suction member 12, the suction member 12 having a hose attachment port 20, a suction port 22, and an integrally formed blade member 14; providing a hose member 24, the hose member 24 having a first end 26 and a second end 28, with the first end 26 of the hose 24 being adapted for connection to the hose attachment port 20 of the suction member 12; providing a vacuum source, the second end 28 of the hose member being adapted to connect to the vacuum source; attaching the suction member 12 with integral blade member 14 to a selected clipper body 18; connecting the hose 24 to the vacuum source; activating the clipper body 18 for clipping; activating the vacuum source 30; clipping hair 120 from the selected surgical site; and drawing the clipped hair 120 from the surgical site through the suction port 22 and hose member 24 and towards the vacuum source 30. The method may further include the step of providing an in-line filter 32 located on the hose member 24 to collect the hair clippings 120. The method may alternatively include the step of providing the vacuum source 30 with a filter 32.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A hair clipper system comprising:

a suction member having a suction port, a hose attachment port, a top surface and a bottom surface;

a blade member, said blade member being integrated with the bottom surface of said suction member;

a clipper body engagement structure, said clipper body engagement structure located on the top surface of the suction member and being adapted to couplingly engage a selected clipper body;

a hose member, said hose member having a first end and a second end, said first end being adapted for connection with said hose attachment port of said suction member; and a vacuum source adapted for coupling to said second end of said hose member.

2. The system of claim 1 further including a fastening member, said fastening member adapted for affixing onto a selected hair clipper body, said fastening member being attached to said suction member.

3. The system of claim 1 wherein the clipper body is a surgical hair clipper.

4. The system of claim 1 wherein the vacuum source is a vacuum pump.

5. The system of claim 1 further comprising a filter placed in the vacuum source for collecting vacuumed hair.

6. The system of claim 1 further comprising an in-line filter placed in the hose member for collecting vacuumed hair.

7. The system of claim 1 wherein said clipper body engagement structure is a slide fit structure.

* * * * *

UNITED STATES PATENT AND TRADEMARK OFFICE

CERTIFICATE OF CORRECTION

PATENT NO. : 8,561,303 B2
APPLICATION NO. : 13/040548
DATED : October 22, 2013
INVENTOR(S) : Landrie et al.

It is certified that error appears in the above-identified patent and that said Letters Patent is hereby corrected as shown below:

Title page, item (56) References Cited U.S. Patent Documents

Delete "3,440,661 4/1969 Hixon et al." and substitute -- 3,440,681 4/1969 Hixson et al. --

Signed and Sealed this
Thirty-first Day of December, 2013

Margaret A. Focarino

Margaret A. Focarino
*Commissioner for Patents of the United States Patent and Trademark Office*